US010502003B2

(12) United States Patent
Johnson

(10) Patent No.: US 10,502,003 B2
(45) Date of Patent: Dec. 10, 2019

(54) PRESSURE AND THERMAL COMPENSATION SYSTEM FOR SUBTERRANEAN HYDRAULIC CONTROL LINE CONNECTORS

(71) Applicant: BAKER HUGHES, A GE COMPANY, LLC, Houston, TX (US)

(72) Inventor: Joshua R. Johnson, Spring, TX (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 193 days.

(21) Appl. No.: 15/195,068

(22) Filed: Jun. 28, 2016

(65) Prior Publication Data

US 2017/0016283 A1 Jan. 19, 2017

Related U.S. Application Data

(60) Provisional application No. 62/191,889, filed on Jul. 13, 2015.

(51) Int. Cl.
*E21B 17/02* (2006.01)
*E21B 33/038* (2006.01)

(52) U.S. Cl.
CPC ..... *E21B 17/02* (2013.01); *E21B 33/038* (2013.01)

(58) Field of Classification Search
CPC ..... E21B 17/02; E21B 17/021; E21B 17/08; E21B 33/0355; E21B 33/038; E21B 34/10
See application file for complete search history.

(56) References Cited

U.S. PATENT DOCUMENTS 4,655,292 A * 4/1987 Halbardier ..... E21B 36/00 166/187
6,755,253 B2 6/2004 Smith et al.
2007/0144746 A1* 6/2007 Jonas ..... E21B 17/028 166/380
2014/0034329 A1* 2/2014 Skinnes ..... E21B 19/09 166/355
2014/0069633 A1* 3/2014 June ..... E21B 23/00 166/212

* cited by examiner

*Primary Examiner* — Robert E Fuller
*Assistant Examiner* — Lamia Quaim
(74) *Attorney, Agent, or Firm* — Shawn Hunter

(57) ABSTRACT

A wet connection system has pressure compensation operative when running in and thermal effects compensation active in the duration between running in and supporting a bottom hole assembly and hooking up a production string having a mating upper part of the wet connect to the lower part of the wet connect already in the hole. The thermal compensation system is then defeated by locking a floating piston so that applied pressure in a given control line will be used to operate an associated tool connected to that control line. Multiple control lines each similarly compensated are envisioned. The pressure compensation system comes out of the hole with the running tool for the bottom hole assembly.

11 Claims, 7 Drawing Sheets

PRESSURE AND THERMAL COMPENSATION SYSTEM FOR SUBTERRANEAN HYDRAULIC CONTROL LINE CONNECTORS

CROSS REFERENCE TO RELATED APPLICATION

This application is claims priority from U.S. Provisional Patent Application Ser. No.: 62/191,889, filed on Jul. 13, 2015.

FIELD OF THE INVENTION

The field of the invention is connectors for hydraulic control lines that are made up or released at a subterranean location and more particularly where the hydraulic fluid in the control line between a lower half of a wet connect and the tools to be operated hydraulically is pressure compensated when running in and thermally compensated until the upper part of the wet connect is mated to the lower part.

BACKGROUND OF THE INVENTION

Bottom hole assemblies can be run in with a connector at an upper end for later receiving a mating connector to finish a production assembly to the surface. This connector is referred to in the industry as a wet connector. There can be a long delay between when the bottom hole assembly is run in and when the halves of a wet connection are made up. The bottom hole assembly with the lower half of the wet connect and hydraulic lines in between the two are run in with a running tool releasably mated to the lower half of the wet connect. Once the bottom hole assembly is supported at a desired location, the running tool is released from the lower half of the wet connect. Because of hydrostatic pressure at the support location acting on the outside of the control lines against captive atmospheric pressure within the control line there exists a potential for collapse of the control lines due to the differential pressure. One attempt to address this issue is shown in U.S. Pat. No. 6,755,253, where a floating piston is referenced to wellbore hydrostatic on one side and control line internal pressure on the other side for running in. The pressure compensation device in this reference stays with the bottom hole assembly and the floating piston is continually allowed to float even after pressure compensation occurs on running in. The reference does not discuss thermal load compensation at all.

In prior systems at relatively shallow depth of about 2000 meters or less, the developed hydrostatic differentials on the control lines were fairly minimal and there were no attempts to compensate for developed pressures. Similarly at relatively shallow depths the well temperatures were not so great so that thermally induced pressure effects could also be safely ignored. As depths increased to over 10,000 meters failing to compensate for such effect could lead to component damage as the upper half of the wet connect was brought into contact with the lower half and pressure release occurred which could destroy adjacent pressure seals to the erosive aspects of high velocity fluids. At these greater depths the temperatures in the range of 150 degrees Centigrade created pressure effects that required compensation to minimize equipment damage.

The present invention addresses the immediate need for pressure compensation on running in with a pressure compensation system associated with a running tool for the bottom hole assembly. In that way the pressure compensating system is removed with the running tool when it is no longer needed. A thermal compensation system remains with the lower portion of the wet connection during the time between running in and connecting a production string with an upper half of the wet connection at its lower end and control line extending outside the production string to the surface. This time interval can be fairly lengthy in the order of months or even longer. The thermal compensating system uses a lockable piston so that on connection of the production string with the upper portion of the wet connect at its lower end to the lower portion of the wet connect a provision exists to lock the thermal compensation system so that applied control line pressure from the surface can go directly to the tools to be operated without such developed pressure being dissipated due to piston movements for the thermal compensation assembly. These and other aspects of the present invention will be more readily apparent to those skilled in the art from a review of the description of the preferred embodiment and the associated drawings while recognizing that the full scope of the invention can be determined from the appended claims.

SUMMARY OF THE INVENTION

A wet connection system has pressure compensation operative when running in and thermal effects compensation active in the duration between running in and supporting a bottom hole assembly and hooking up a production string having a mating upper part of the wet connect to the lower part of the wet connect already in the hole. The thermal compensation system is then defeated by locking a floating piston so that applied pressure in a given control line will be used to operate an associated tool connected to that control line. Multiple control lines each similarly compensated are envisioned. The pressure compensation system comes out of the hole with the running tool for the bottom hole assembly.

DETAILED DESCRIPTION OF THE PREFERRED EMBODIMENT

Figure 1:
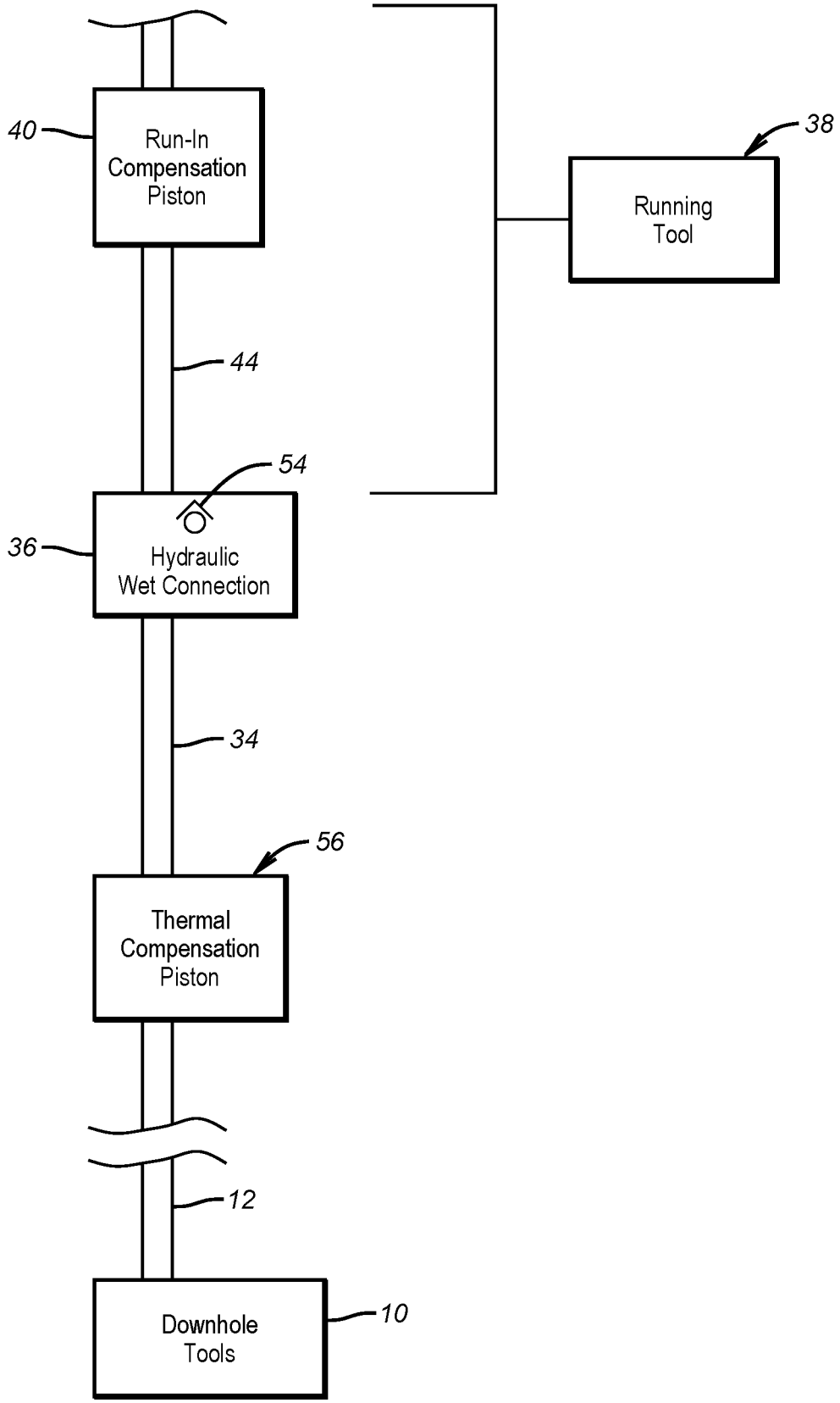
FIG. 1 shows the relative positions of the pressure and thermal effects compensation systems.
Figure 2:
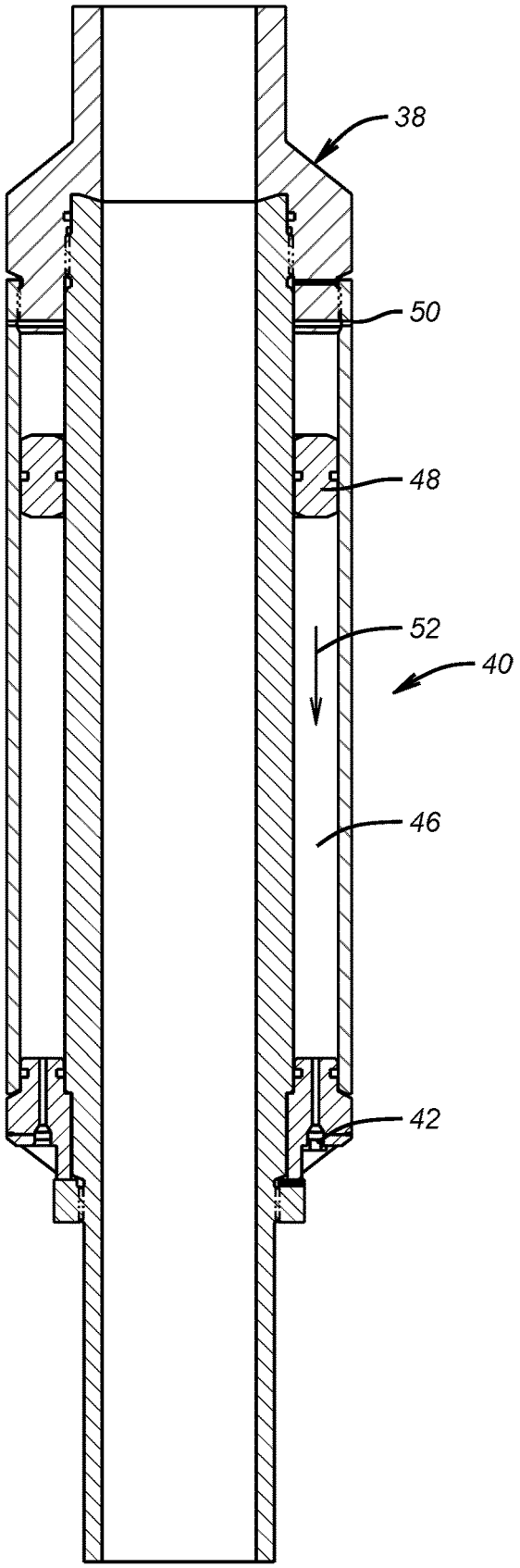
FIG. 2 is a detailed view of the pressure compensation system mounted to the running tool.
Figure 3:
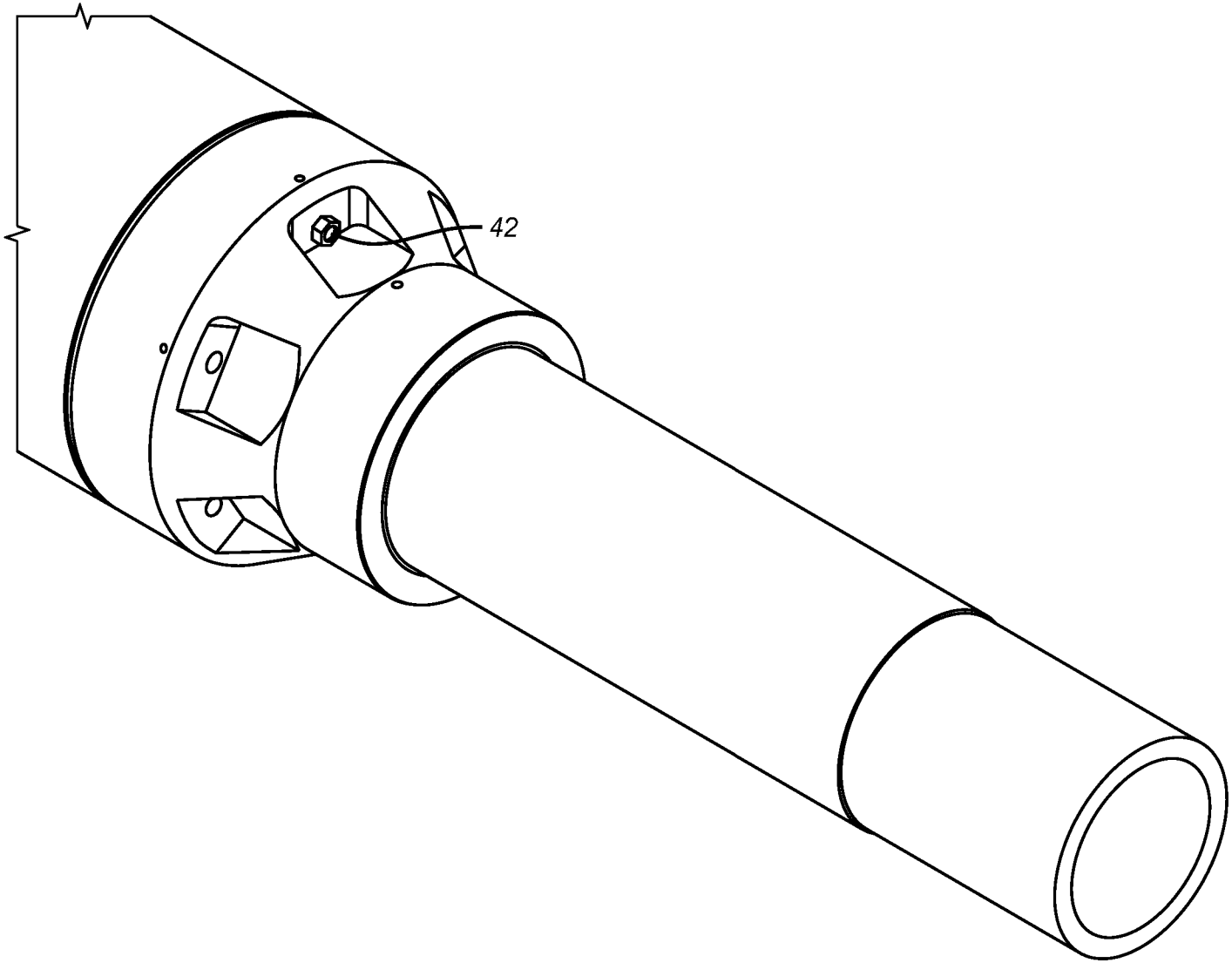
FIG. 3 is a perspective view of the lower end of the pressure compensation system shown in FIG. 2.
Figure 4:
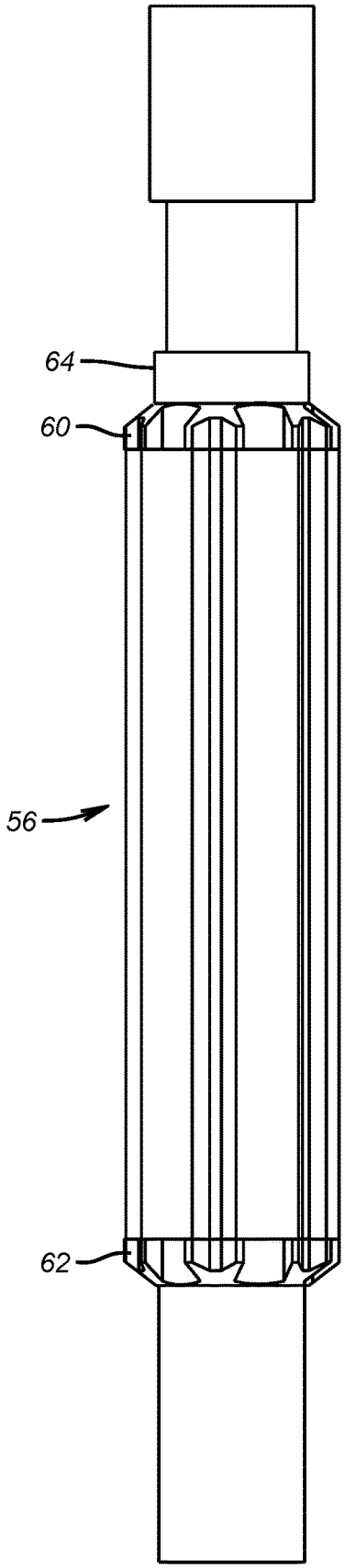
FIG. 4 is an exterior view of the temperature compensation system mounted to the lower wet connect.
Figure 5:
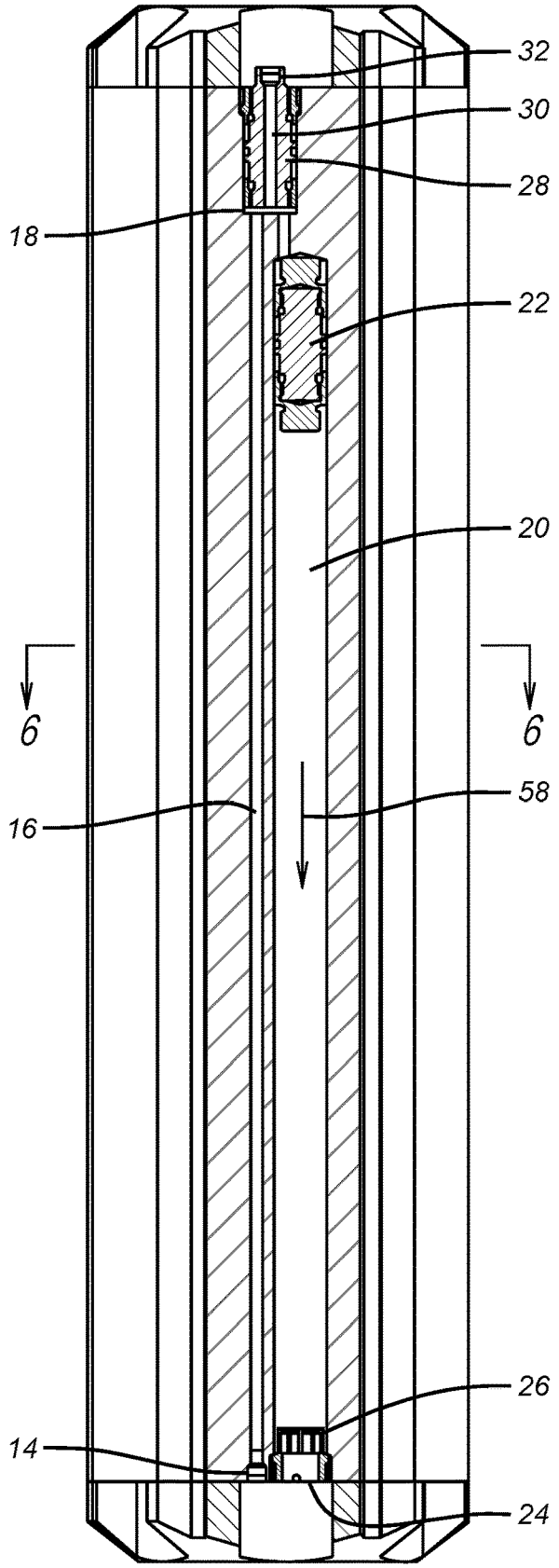
FIG. 5 is a section view of FIG. 4 with the dynamic piston in the run in location.
Figure 6:
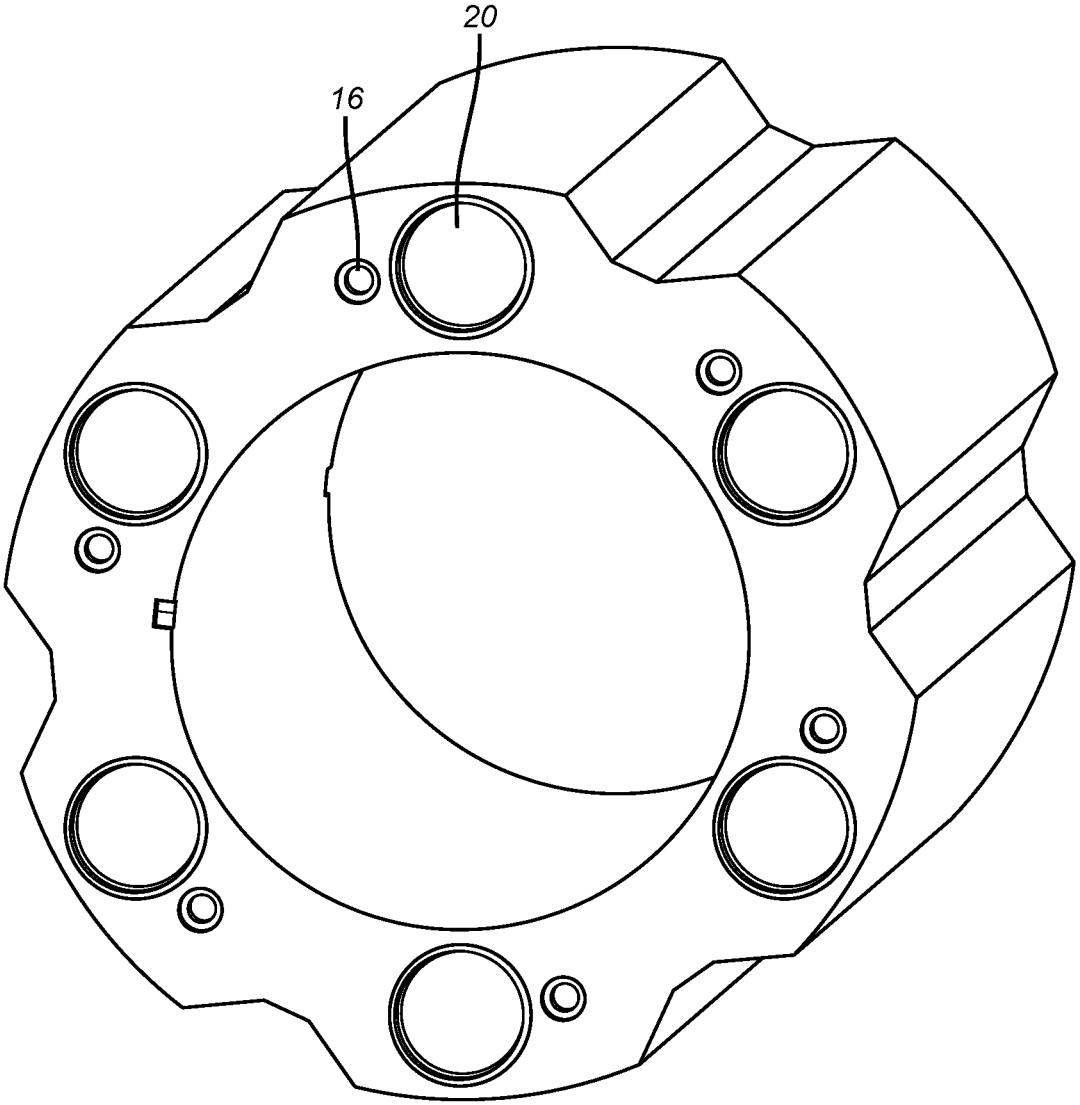
FIG. 6 is a section view along line 6-6 of FIG. 5 and rotated for a perspective view.
Figure 7:
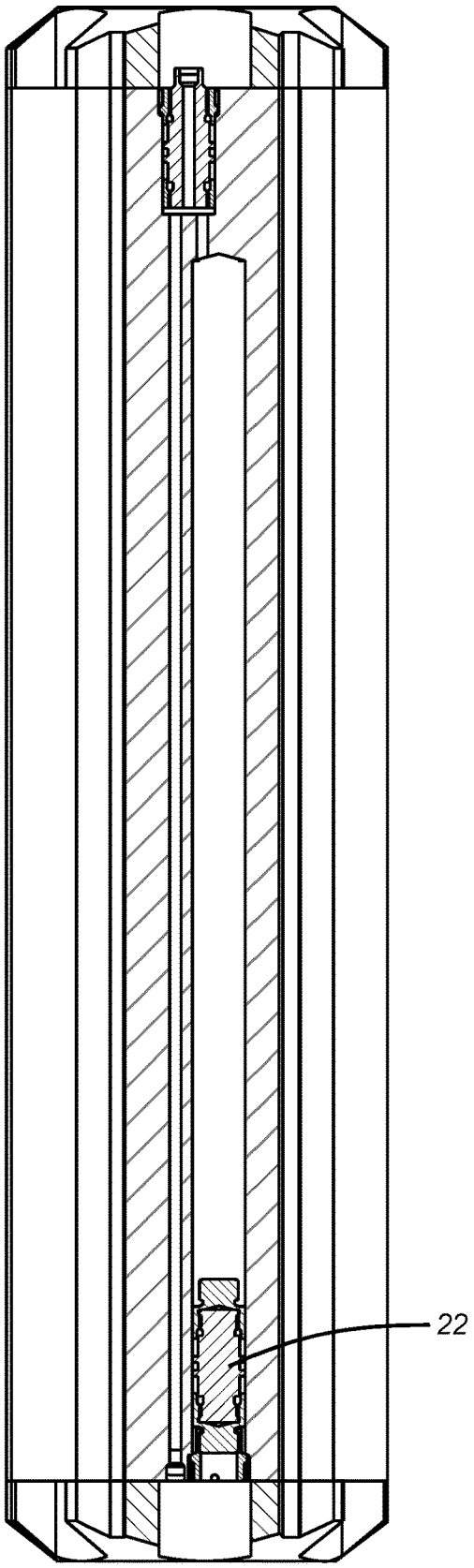
FIG. 7 is the view of FIG. 5 with the dynamic piston latched using pressure in the control line after the upper assembly is connected at the wet connect.

FIG. 1 illustrates an overall layout of the component parts. The tool or tools 10 that are to be hydraulically operated are at the lower end connected by one or more hydraulic lines 12 with one or more lines going to each tool. Each of the lines 12 represent a distinct hydraulic circuit to complete a specific tool movement. Each of the lines 12 extend to a connection such as 14 best seen in FIG. 5. Each of the multiple connections 14 extend through a drilled bore 16 to an enlarged bore 18. Bore 20 runs preferably parallel to bore 16 and the two communicate at enlarged bore 18. A dynamic piston 22 with associated seals is movably mounted in bore 20. There is an open lower end 24 at which is mounted a collet latch 26. Piston 22 is free to move in opposed directions until it is deliberately forced against latch 26 at which time piston 22 is locked. Insert 28 is sealingly secured in enlarged bore 18 and has a through passage 30 which forms a continuation of drilled bore 16. A connection 32 allows a hydraulic line 34 to be connected. There are multiple such connections 32 with each one connected to a discrete hydraulic control line. As seen in FIG. 1 the lines 34 extend to the lower half of a wet connect 36 that is run into the hole and supported using a running tool 38 that is a known design. Generally one of the downhole tools 10 or an existing support is used for the support function to allow the running tool 38 to release from the wet connect lower portion 36. The running tool assembly 38 further contains a running in pressure compensation device 40 best seen in FIG. 2. Multiple connections 42 are used with discrete lines to connect to lines 34 through the wet connect lower portion 36. An annular chamber 46 has a floating piston 48 and a communication port 50 open to the surrounding annulus. As the components get further in the wellbore the hydrostatic pressure at port 50 increases forcing piston 48 to move toward connection 42 to equalize pressure seen at port 50 with the internal pressure in the individual hydraulic lines starting at connections 42 to their individual terminations at respective tools 10.

The running tool assembly terminates at its lower end with a mating upper component to the wet connect lower portion 36. The running tool assembly 38 can release from lower portion 36 usually with a combined movement of rotation and a pickup force. When that happens, the running tool assembly 38 can come out of the hole taking with it the pressure compensation assembly 40. It should be noted that there is no lock feature on the movements of piston 48. This is because it is only needed one time for running in where increasing hydrostatic pressure at port 50 moves piston 48 in the direction of arrow 52. After serving that one purpose it is no longer needed and comes out of the hole with the running tool assembly 38. The separation of wet connect parts as the running tool assembly 38 comes out of the hole leaves the lower portion 36 exposed waiting for a production string that is not shown that can be installed days or months later. Each of the lines 34 connected to the lower portion 36 have a check valve 54 to prevent hydraulic fluid exit from lines 34. Since the ambient well temperature can be in order of about 150 degrees Centigrade pressure can build in lines 34 that is compensated by movement of the piston 22. However, when a production line is connected to lower portion 36 and it is desired to function the tools 10 hydraulically, the movement of the piston 22 needs to be arrested so that applied hydraulic pressure will be delivered to tools 10 rather than being dissipated moving piston 22. For that reason after the production string is hooked up to lower portion 36 hydraulic pressure from the surface through lines attached outside the production string will initially displace piston 22 to a locked position against latch 26 and thereafter each control line will function normally. The piston 48 needs no such locking feature as it moves once in the direction of arrow 52 to pressure compensate the hydraulic lines between lower portion 36 and tools 10 and its purpose is done. It is removed with the running tool assembly 38 thus removing potential leak locations around piston 48 during production.

On the other hand the thermal compensation assembly 56 stays with the lower portion 36 when the production string is delivered to mate with lower portion 36. Thermal loads from borehole fluids before the production string is connected are compensated as piston 22 moves in the direction of arrow 58 in each of the connected hydraulic lines 12 and 34. The pistons 22 are then locked to respective latches 26 when the production line is connected at lower portion 36.

Depending on the internal valving of the lower portion 36 it is possible to use the thermal compensation system 56 as both a hydrostatic pressure compensator when running in and a thermal compensator after running in and before the production line is connected. Gage rings 60 and 62 along with retaining ring 64 are used to hold the thermal compensation assembly 56 in position.

While there is a functional similarity of the hydrostatic pressure compensation system shown in U.S. Pat. No. 6,755,253 there are also differences. In the preferred embodiment the pressure compensation system 40 is removable so that no latch on piston 48 is needed. The system in the prior art stays in the hole with the piston able to move after the production line is connected which can affect the operation of the connected tools as well as provide additional potential hydraulic fluid leak paths.

The above description is illustrative of the preferred embodiment and many modifications may be made by those skilled in the art without departing from the invention whose scope is to be determined from the literal and equivalent scope of the claims below:

I claim:

1. A borehole wet connect assembly for connecting a tubular string and at least one associated conduit in the borehole to at least one borehole tool, comprising:

a lower housing for the wet connect adapted to connect to the borehole tool comprising a flow line and at least one auxiliary fluid conduit to connect to an operator for the borehole tool;

said at least one auxiliary fluid conduit associated with said lower housing comprising a moveable first compensating piston with a first end thereof pressure referenced to outside said housing and a second end thereof in sealing engagement with said at least one auxiliary fluid conduit;

said movable first compensating piston selectively locked to said housing by a latch that is located within the auxiliary fluid conduit following movement of the first compensating piston within the auxiliary fluid conduit.

2. The assembly of claim 1, wherein:

said movable first compensating piston moveable in a predetermined range without selectively locking.

3. The assembly of claim 1, wherein:

said movable first compensating piston moveable responsive to thermal input to said housing.

4. The assembly of claim 1, wherein:

said movable first compensating piston moveable responsive to pressure input to said at least one auxiliary fluid conduit.

5. The assembly of claim 3, wherein:

said movable first compensating piston moveable responsive to pressure input to said at least one auxiliary fluid conduit.

6. The assembly of claim 1, further comprising:

a running tool for said lower housing for placement of said lower housing and the borehole tool in a predetermined location, said running tool further comprising at least one running tool auxiliary conduit in fluid communication with said at least one auxiliary conduit on said lower housing, said at least one auxiliary conduit on said running tool comprising a second compensating piston with a first end thereof referenced to outside said running tool and a second end thereof in sealing engagement with said at least one auxiliary fluid conduit in said running tool.

7. The assembly of claim 6, further comprising:

said running tool is removably attached to said lower housing.

8. The assembly of claim 7, further comprising:

said second compensating piston is removable from the borehole with said running tool.

9. The assembly of claim 6, further comprising:

said second compensating piston responsive to pressure changes outside said running tool as said running tool is inserted into the borehole.

10. The assembly of claim 6, further comprising:

said second compensating piston is movable in a predetermined range in opposed directions without restraint.

11. The assembly of claim 1 wherein the latch is a collet latch.

* * * * *